United States Patent [19]

Queren

[11] 4,074,484

[45] Feb. 21, 1978

[54] DOORWAY FRAMING

[76] Inventor: James Queren, 218-07 43rd Ave., Bayside, N.Y. 11361

[21] Appl. No.: 731,304

[22] Filed: Oct. 12, 1976

[51] Int. Cl.[2] ..... E05C 21/00; E06B 1/04

[52] U.S. Cl. ..... 52/214; 49/504; 292/346

[58] Field of Search ..... 52/210, 213, 214, 211, 52/216; 49/504, 503, 460, 462; 292/346; 70/416, 452

[56] References Cited

U.S. PATENT DOCUMENTS

| | | | |
|---|---|---|---|
| 3,918,207 | 11/1975 | Aliotta | 49/504 |
| 4,005,890 | 2/1977 | Murch | 292/346 |

*Primary Examiner*—J. Karl Bell

*Attorney, Agent, or Firm*—Kurt Kelman

[57] ABSTRACT

A door is secured against being kicked in by a doorway construction which comprises a conventional wooden door frame side rail defining a door latch bolt hole in a recessed end portion of one of its major faces and a conventional wall including two-by-four studs adjacent the other major face of the door frame side rail, with the minor faces thereof extending parallel to the wall. The weak point of such a frame is in the region of the hole and this is protected by a reinforcement plate extending over a substantial portion of the wall studs and a substantial portion of the minor face of the door frame side rail overlying the hole. The plate is securely affixed to the wall studs and the door frame side rail and covers this region.

7 Claims, 2 Drawing Figures

DOORWAY FRAMING

BACKGROUND OF THE INVENTION

The present invention relates to a secured doorway framing, and more particularly to a protective reinforcement plate securely affixed to a wall stud means and an adjoining door frame side rail to prevent unlawful entry into a structure closed by a door.

One of the easiest and most common ways of breaking into a home or other building is to kick in the door if it is not possible to tamper with the lock. Since the wooden door frame side rail of the door frame is weakened at the point where it defines a door latch bolt hole receiving the lock bolt, a well-placed kick near that point, i.e. at the level of the lock, can easily cause the door jamb to split and crack, thereby permitting an unauthorized person or persons to enter.

Virtually all residences have wooden door frames and frame houses have walls whose wall boards are attached to wooden studs, such as two-by-fours, the doorway framing including door frame side rails adjacent the wall studs. Wooden or composition board doors are mounted in such a framing by hinging one side of the door to one door frame side rail while the other side of the door has a lock recessed thereinto, with a latch bolt projecting therefrom into a latch bolt hole in the other door frame side rail. A striker plate is usually mounted on this side rail over the hole and has a hole aligned therewith to permit the latch bolt to enter for locking the door and to be withdrawn therefrom by the operation of a key for opening the door. Due to the small amount of door frame material remaining between the latch bolt hole and the inside edge of the frame, a suitable force, such as a kick, at or near this point will cause this portion of the door frame to crack or split, thereby permitting unwanted entry.

One approach to the prevention of undesired entry is an attempt to prevent jimmying of locks and, for that purpose, a number of proposals have been made to mount protective shields over the gap between the door and the door jamb so as to make it impossible for anyone to insert a thin instrument therebetween for forcing the bolt to be retracted. Guard plates of this type are disclosed, for instance, in U.S. Pat. Nos. 3,279,840, 3,405,962, 3,592,498, 3,645,045 and 3,874,717. These plates are not designed to reinforce the doorway framing but merely prevent access to various portions of the lock.

U.S. Pat. No. 3,815,945 discloses a door frame security plate ostensibly designed to prevent the door from being kicked in. This however, requires additional weakening of the jamb by milling out a seat for the security plate and, in addition, the plate extends in the general direction of any force that would be applied to break in. Therefore, it fails to provide a desirable reinforcement securing the frame against being split.

SUMMARY OF THE INVENTION

It is the primary object of this invention to prevent entry into a house or other building by forceable means, such as kicking-in of a door.

It is another object of the invention to accomplish this by a relatively simple installation of a reinforcement plate which is inexpensive and may be mounted in new and existing doorway framings with a minimum of expense.

This and other objects are accomplished in accordance with the present invention in a doorway framing which conventionally comprises a wooden door frame side rail having two substantially parallel major faces and two minor faces substantially perpendicular to the major faces, one of the major faces having a recessed end portion delimited by one of the minor faces and a shoulder constituting a stop for a door, and the door frame side rail defining a door latch bolt hole in the recessed end portion, and a wall including wooden wall stud means adjacent the other major face of the door frame side rail, the door frame side rail being mounted on the wall and the minor faces of the door frame side rail extending substantially parallel to the wall. A reinforcement plate extends over a substantial portion of the wall stud means and a substantial portion of the one minor face of the door frame side rail, the reinforcement plate being securely affixed to the wall stud means and the door frame side rail and covering a region of the minor door frame side rail face adjacent the door latch bolt hole.

In this manner, the weak point of the framing overlying the door latch bolt hole is protected by the reinforcement plate which extends over the doorway framing substantially perpendicularly to any break-in force applied thereagainst, thus securely protecting the framing from splitting or breaking.

BRIEF DESCRIPTION OF THE DRAWING

The above and other objects, advantages and features of this invention will become more apparent from the following detailed description of a now preferred embodiment thereof, taken in conjunction with the accompanying drawing wherein.

DETAILED DESCRIPTION

Figure 1:
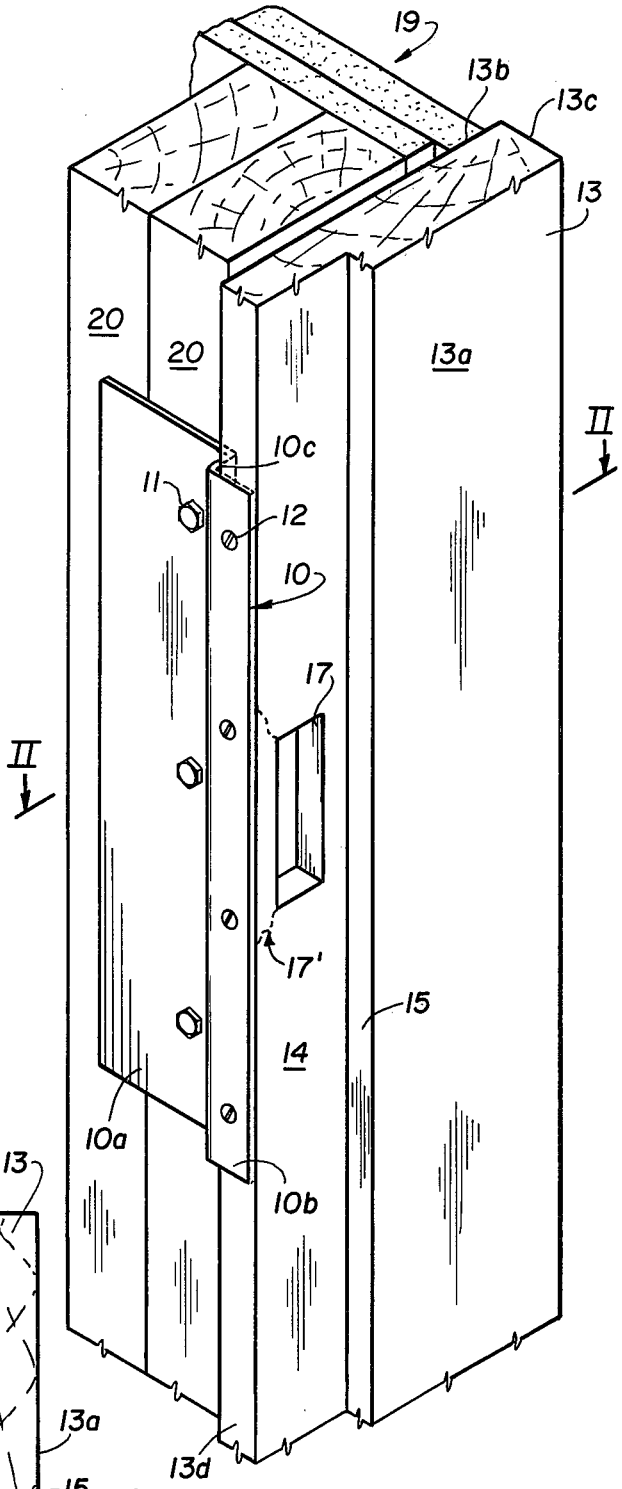
FIG. 1 is a partial perspective view of a portion of a doorway framing in the region of the door latch bolt hole and FIG. 2 is a transverse section along line II—II of FIG. 1, also showing a portion of the door, in section, as well as a covering wall board and molding.

Referring now to the drawing, reinforcement plate 10 of the invention is shown as a strong plate, preferably of steel, such as 14-gauge steel comprising major plate portion 10*a*, minor plate portion 10*b* and web portion 10*c* interconnecting the major and minor plate portions. Any strong sheet material may be used for plate 10 as long as it is suitable to resist pressure applied thereagainst, for instance by kicking. In addition to steel, cast or extruded aluminum plate may be found useful for this purpose, for example, as well as some strong, reinforced synthetic resin plating. The dimensions of the reinforcement plate will depend primarily on the doorway framing dimensions and will be suitably chosen to protect a large enough region of the framing. In a preferred embodiment, the plate may be 12 inches long and 3½ inches wide, the major plate portion having a width of 2½ inches and the minor plate portion having a width of 1 inch. These dimensions are given merely by way of example and a reinforcement plate of such dimensions has been found effectively to secure and protect a doorway framing. However, it will be readily understood by those skilled in the art that various dimensions may be selected to suit individual purposes and use available plate sizes.

The major and minor plate portions define a plurality of screw holes to receive means for securely affixing the plate to the door framing, the illustrated means being threaded fastening elements, such as bolts or screws 11 and 12, penetrating deeply into the door framing parts to which plate 10 is affixed. The illustrated bolts 11 have a length of 3 inches while the screws 12 have a length of 2 inches but, here again, the dimensions of the fastening elements may be varied widely as long as they securely affix the plate.

Figure 2:
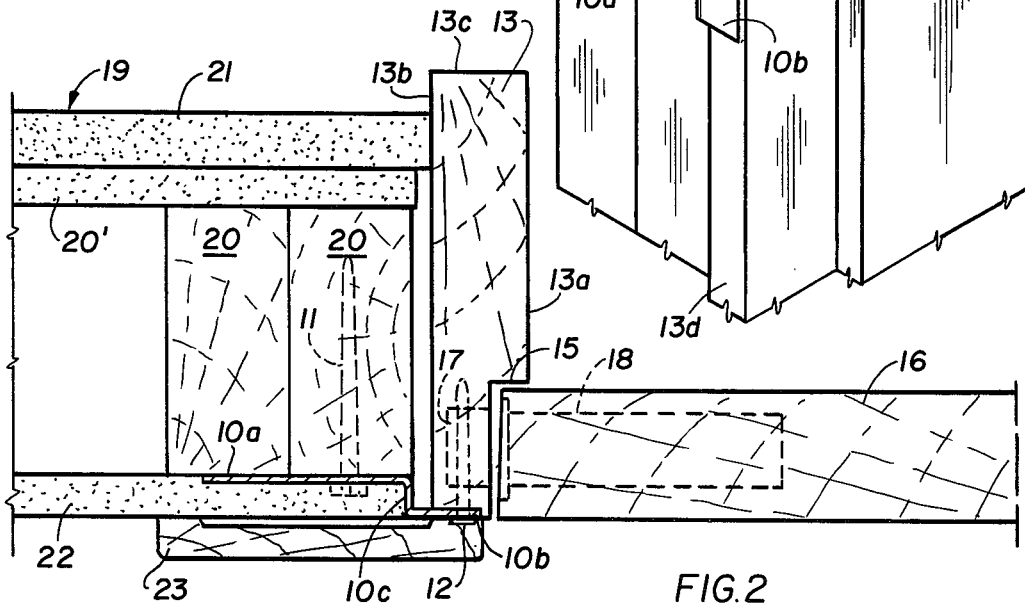

The doorway framing illustrated in the drawing is generally conventional and comprises wooden door frame side rail 13 having two substantially parallel major faces 13*a*, 13*b* and two minor faces 13*c*, 13*d* substantially perpendicular to the major faces. Major face 13*a* has a recessed end portion 14 delimited by minor face 13*d* and shoulder 15 constituting a stop for door 16 (shown only in FIG. 2). Door frame side rail 13 defines door latch bolt hole 17 in recessed end portion 14. Recessed into door 16 is lock 18 which has a latch bolt arranged to project into hole 17 for locking the door. Normally, although not shown, a striker plate with a hole aligned with hole 17 will be mounted over hole 17, all of this structure being entirely conventional.

The illustrated doorway framing further comprises a generally conventional wall 19 including wood wall stud means constituted in the illustrated embodiment by two adjoining two-by-four wall framing studs 20, 20 adjacent major face 13*b* of door frame side rail 13. The door frame side rail is mounted on the wall so that minor faces 13*c*, 13*d* of door frame side rail 13 extend substantially parallel to the wall.

As shown in the drawing, in the illustrated framing minor face 13*d* of the door frame side rail is positioned in a first place and the wall studs have a face positioned in a second plane inwardly recessed from the first plane. Major reinforcement plate portion 10*a* is securely affixed to the recessed face of wall studs 20, 20 by bolts 11 and minor plate portion 10*b* is securely affixed to minor face 13*d* of the door frame side rail. The wall is shown to include an exterior wall including wall board 20 and facing 21, as well as an interior wall board 22 which may be, for instance, a gypsum board of plaster. Wall board 22 extends over major reinforcement plate portion 10*a* to web portion 10*c* and is flush with minor reinforcement plate portion 10*b*. Furthermore, molding 23, which may be of wood, covers minor face 10*b* of the door frame side rail and an adjoining portion of wall 19 whereby the reinforcement plate is hidden from view.

As is shown in FIG. 1 at 17′, the door frame side rail has a weak point caused by the provision of door latch bolt hole 17 in the jamb and which could easily split or break if the door is kicked in but which is protected against such force by reinforcement plate 10 which extends perpendicularly thereto about 6 inches above and below the center of the door latch hole.

In an existing doorway framing of the illustrated type, it will merely be necessary to remove molding 23 and a small portion of gypsum board or plaster 22 in front of studs 20, 20. Major reinforcement plate portion 10*a* is then bolted to the studs and minor plate portion 10*b* is screwed to jamb 13. The molding is then remounted to conceal the reinforcement plate. In a new building, the reinforcement plate will be mounted before wall board 22 is put into place. Either way, the installation is simple, easy and inexpensively provided with a minimum of time and effort.

What is claimed is:

1. A doorway framing comprising, in combination:

1. a wooden door frame side rail having two substantially parallel major faces and two minor faces substantially perpendicular to the major faces, one of the major faces having a recessed end portion delimited by one of the minor faces and a shoulder constituting a stop for a door, and the door frame side rail defining a door latch bolt hole in the recessed end portion,
2. a wall including wooden wall stud means adjacent the other major face of the door frame side rail, the door frame side rail being mounted on the wall and the minor faces of the door frame side rail extending substantially parallel to the wall, and
3. a reinforcement plate extending over a substantial portion of the wall stud means and a substantial portion of the one minor face of the door frame side rail, the reinforcement plate being securely affixed to the wall stud means and the one minor face of the door frame side rail and covering a substantial region of the minor door frame side rail face adjacent and beyond the door latch bolt hole, the securely affixed plate holding the side rail of the wooden door frame firmly in position.

2. The doorway framing of claim 1, further comprising a plurality of elongated threaded fastening elements penetrating deeply into the wooden wall stud means and door frame side rail, respectively, for securely affixing the reinforcement plate.

3. The doorway framing of claim 1, wherein the one minor face of the door frame side rail is positioned in a first plane and the wall stud means has a face positioned in a second plane inwardly recessed from the first plane, the reinforcement plate comprising a major plate portion securely affixed to the recessed face of the wall stud means, a minor plate portion securely affixed to the one minor face of the door frame side rail and a web portion interconnecting the major and minor plate portions and extending adjacent and parallel to the other major face of the side rail.

4. The doorway framing of claim 3, wherein the wall stud means consists of two adjoining two-by-four wall framing studs and the wall comprises all boards mounted on the wall stud means, one of the wall boards extending over the major reinforcement plate portion to the web portion of the reinforcement plate and being flush with the minor reinforcement plate portion.

5. The doorway framing of claim 3, further comprising a molding covering the one minor face of the door frame side rail and an adjoining portion of the wall, the reinforcement plate underlying the molding and hidden thereby.

6. The doorway framing of claim 1, wherein the reinforcement plate has a length in the range of 12 inches, extending about 6 inches above and below the center of the door latch bolt hole.

7. The doorway framing of claim 1, wherein the reinforcement plate is of steel.

* * * * *